US011359779B1

(12) United States Patent
Hsu

(10) Patent No.: US 11,359,779 B1
(45) Date of Patent: Jun. 14, 2022

(54) CEILING LAMP ASSEMBLED QUICKLY

(71) Applicant: Dong Guan Jia Sheng Lighting Technology Co., Ltd. China, Dong-Guna (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 17/381,432

(22) Filed: Jul. 21, 2021

(51) Int. Cl.

| | |
|---|---|
| ***F21S 8/04*** | (2006.01) |
| ***F21V 21/04*** | (2006.01) |
| ***F21V 29/70*** | (2015.01) |
| ***F21V 9/40*** | (2018.01) |
| *F21Y 115/10* | (2016.01) |

(52) U.S. Cl.
CPC ..... *F21S 8/04* (2013.01); *F21V 9/40* (2018.02); *F21V 21/047* (2013.01); *F21V 29/70* (2015.01); *F21Y 2115/10* (2016.08)

(58) Field of Classification Search
CPC ..... F21V 9/40; F21V 21/047; F21S 8/04
See application file for complete search history.

(56) References Cited

FOREIGN PATENT DOCUMENTS

CN 210485472 U * 5/2020

* cited by examiner

*Primary Examiner* — Karabi Guharay
(74) *Attorney, Agent, or Firm* — Karin L. Williams; Alan D. Kamrath; Mayer & Williams PC

(57) ABSTRACT

A ceiling lamp includes a main unit and a wall plate detachably mounted on a top of the main unit. The main unit is provided with a membrane button for regulating a color temperature of the ceiling lamp. The membrane button is arranged on a bottom face or an outer face of the main unit. The main unit includes a lamp body, and a lamp disk mounted on the lamp body from bottom to top. The lamp body includes a rear cover, a heatsink disk, a light emitting diode (LED) driver, an LED module, and a light output module. The heatsink disk is mounted on a bottom of the rear cover. The LED module is mounted between the heatsink disk and the light output module. The LED driver is connected with the LED module.

8 Claims, 8 Drawing Sheets

CEILING LAMP ASSEMBLED QUICKLY

BACKGROUND OF THE INVENTION

1. Field of the Invention

The present invention relates to a lighting apparatus and, more particularly, to a ceiling lamp with multiple color temperature.

2. Description of the Related Art

A conventional ceiling lamp is mounted on the ceiling and comprises a lamp body, a lampshade, a lighting module, a driving module, and a color temperature regulating switch. Thus, the ceiling lamp has a color temperature regulating function by provision of the color temperature regulating switch so as to enhance the aesthetic quality of the ceiling lamp. However, the conventional ceiling lamp is not assembled and disassembled easily and conveniently. In addition, the color temperature regulating switch is arranged in the lamp body, while the lamp body is mounted on the ceiling, so that when the color temperature of the conventional ceiling lamp needs to be switched, the user has to remove the lampshade from the lamp body for regulating the color temperature, thereby causing inconvenience to the user.

BRIEF SUMMARY OF THE INVENTION

The primary objective of the present invention is to provide a ceiling lamp that is assembled easily, quickly, and conveniently.

In accordance with the present invention, there is provided a ceiling lamp comprising a main unit and a wall plate detachably mounted on a top of the main unit. The main unit is provided with a membrane button for regulating a color temperature of the ceiling lamp. The membrane button is arranged on a bottom face or an outer face of the main unit. The main unit includes a lamp body, and a lamp disk mounted on the lamp body from bottom to top. The lamp body includes a rear cover, a heatsink disk, a light emitting diode (LED) driver, an LED module, and a light output module. The heatsink disk is mounted on a bottom of the rear cover. The LED module is mounted between the heatsink disk and the light output module. The LED driver is connected with the LED module.

Preferably, the rear cover has an outer face provided with a rotation shaft and a locking snap. The wall plate has a first end provided with a mounting hole and a second end provided with a press piece. The rotation shaft extends through the mounting hole. The locking snap presses the press piece to secure the wall plate to the rear cover.

Preferably, the rear cover has an outer face provided with two inclined protruding rails. Each of the two inclined protruding rails has a bottom face extending slantingly. The bottom face of each of the two inclined protruding rails has an uppermost position provided with an entrance. The wall plate is provided with two locking blocks formed on two opposite ends thereof. Each of the two locking blocks is introduced respectively through the entrance into the bottom face of one of the two inclined protruding rails.

Preferably, the outer face of the rear cover is provided with a plurality of locking hooks. The lamp disk has an inner face provided with a plurality of limit blocks. Each of the limit blocks is provided with an oblique guide face. Each of the locking hooks is moved downward on and guided by the oblique guide face and locked on a bottom face of one of the limit blocks.

Preferably, the bottom face of each of the two inclined protruding rails has a lowermost position provided with a stop portion for stopping and limiting one of the two locking blocks.

Preferably, the lamp body further includes a front cover mounted on the rear cover from bottom to top. The lamp disk is mounted on the front cover and arranged outside of the front cover.

Preferably, the front cover has an outer face provided with a plurality of locking protrusions. Each of the locking protrusions has a top face extending upward slantingly. The top face of each of the locking protrusions has a lowermost position provided with an entrance. The lamp disk has an inner face provided with a plurality of limit posts. Each of the limit posts is introduced respectively from the entrance into one of the locking protrusions.

Preferably, the top face of each of the locking protrusions is provided with at least two restriction projections. Each of the at least two restriction projections has an arcuate shape in cross section. Each of the limit posts is retained respectively by one of the at least two restriction projections.

Preferably, the light output module is arranged between the LED module and the front cover and includes a reflector, a light guide plate, a glass plate, and a diffuser arranged from top to bottom. The diffuser rests on an inner face of the front cover.

Preferably, the rear cover has a top provided with a color temperature regulating switch.

According to the primary advantage of the present invention, the lamp body is removably mounted on the wall plate, and the lamp disk is removably mounted on the lamp body so that the ceiling lamp is assembled and disassembled easily and conveniently.

According to another advantage of the present invention, the membrane button is arranged on the bottom face or the outer face of the lamp disk, so that the user regulates directly the color temperature of the ceiling lamp without having to remove the lampshade, thereby facilitating operating the ceiling lamp to regulate the color temperature.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
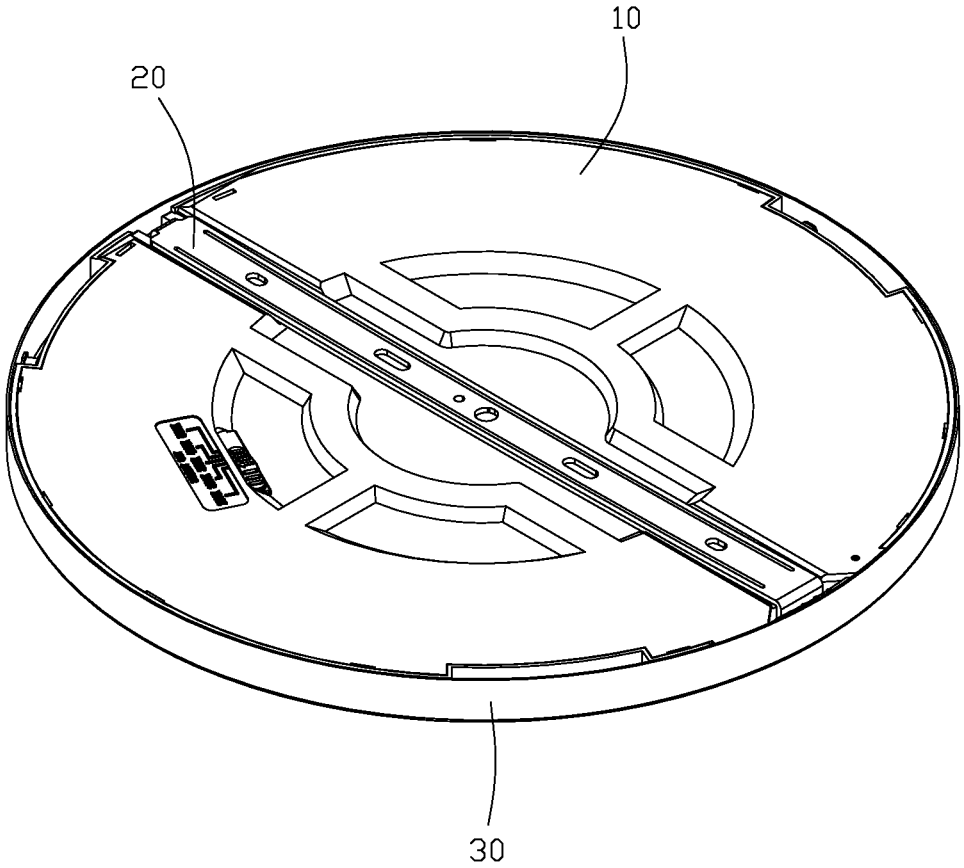
FIG. 1 is a perspective view of a ceiling lamp in accordance with the first preferred embodiment of the present invention.

Referring to the drawings and initially to FIGS. 1-6, a ceiling lamp in accordance with the preferred embodiment of the present invention comprises a main unit and a wall plate 20 detachably mounted on a top of the main unit.

The main unit is provided with a membrane (or film) button 33 for regulating a color temperature of the ceiling lamp. Preferably, the membrane button 33 is arranged on a bottom face or an outer face of the main unit. The main unit includes a lamp body 10, and a lamp disk (or seat) 30 mounted on the lamp body 10 from bottom to top. The lamp disk 30 covers the lamp body 10. The lamp body 10 includes a rear cover 11, a heatsink disk 13, a light emitting diode (LED) driver 14, an LED module 15, and a light output module. The heatsink disk 13 is mounted on a bottom of the rear cover 11 and arranged on an inner face of the lamp body 10. The LED module 15 is mounted between the heatsink disk 13 and the light output module. The LED driver 14 is connected with the LED module 15. The wall plate 20 is mounted on the top of the lamp body 10.

In assembly, the wall plate 20 is mounted on the ceiling (or a wall). Then, one side of the lamp body 10 is hung on the wall plate 20. Then, the other side of the lamp body 10 is pressed upward and locked onto the wall plate 20 to secure the lamp body 10 to the wall plate 20. Finally, the lamp disk 30 is mounted on the lamp body 10.

Figure 2:
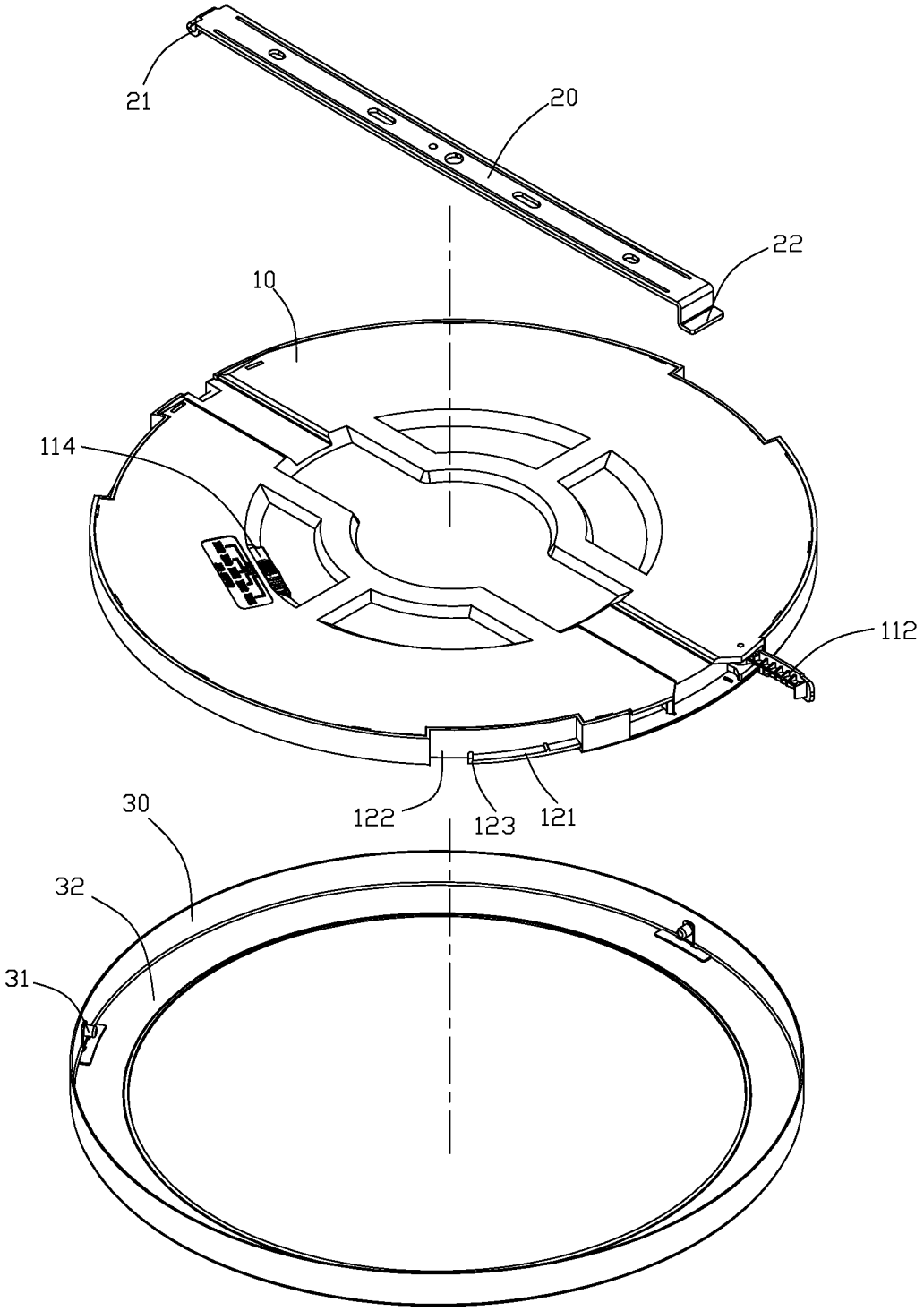
FIG. 2 is a partial exploded perspective view of the ceiling lamp in accordance with the first preferred embodiment of the present invention.
Figure 3:
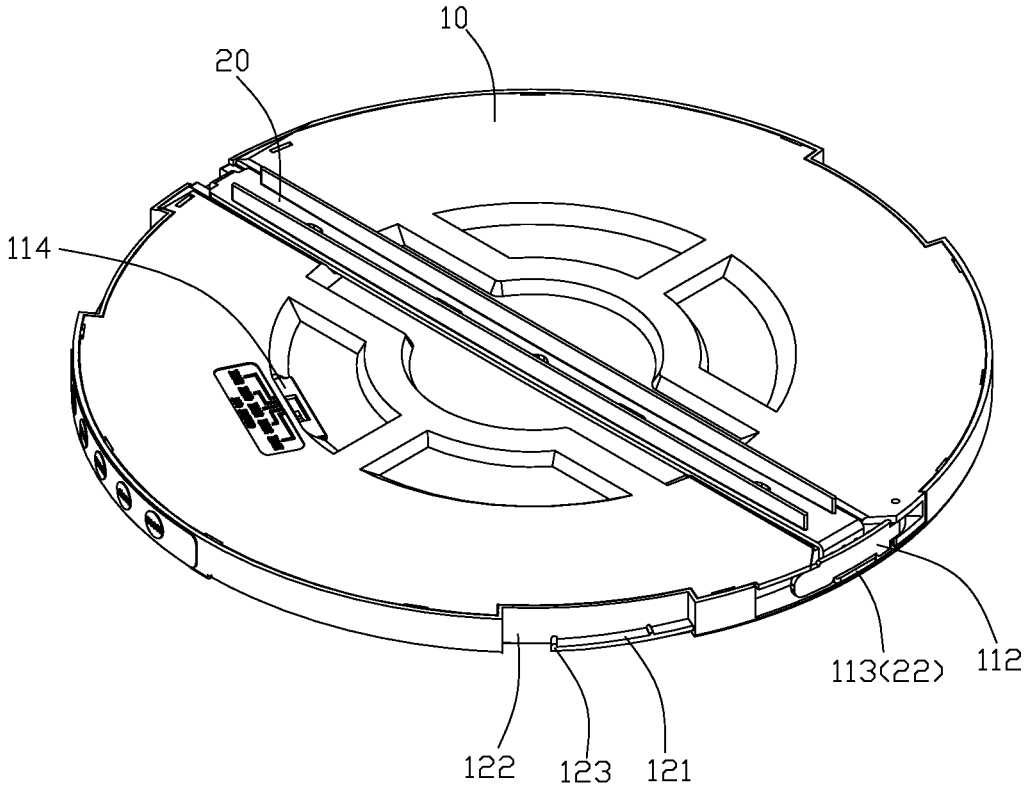
FIG. 3 is a partial perspective view of the ceiling lamp in accordance with the first preferred embodiment of the present invention.
Figure 4:
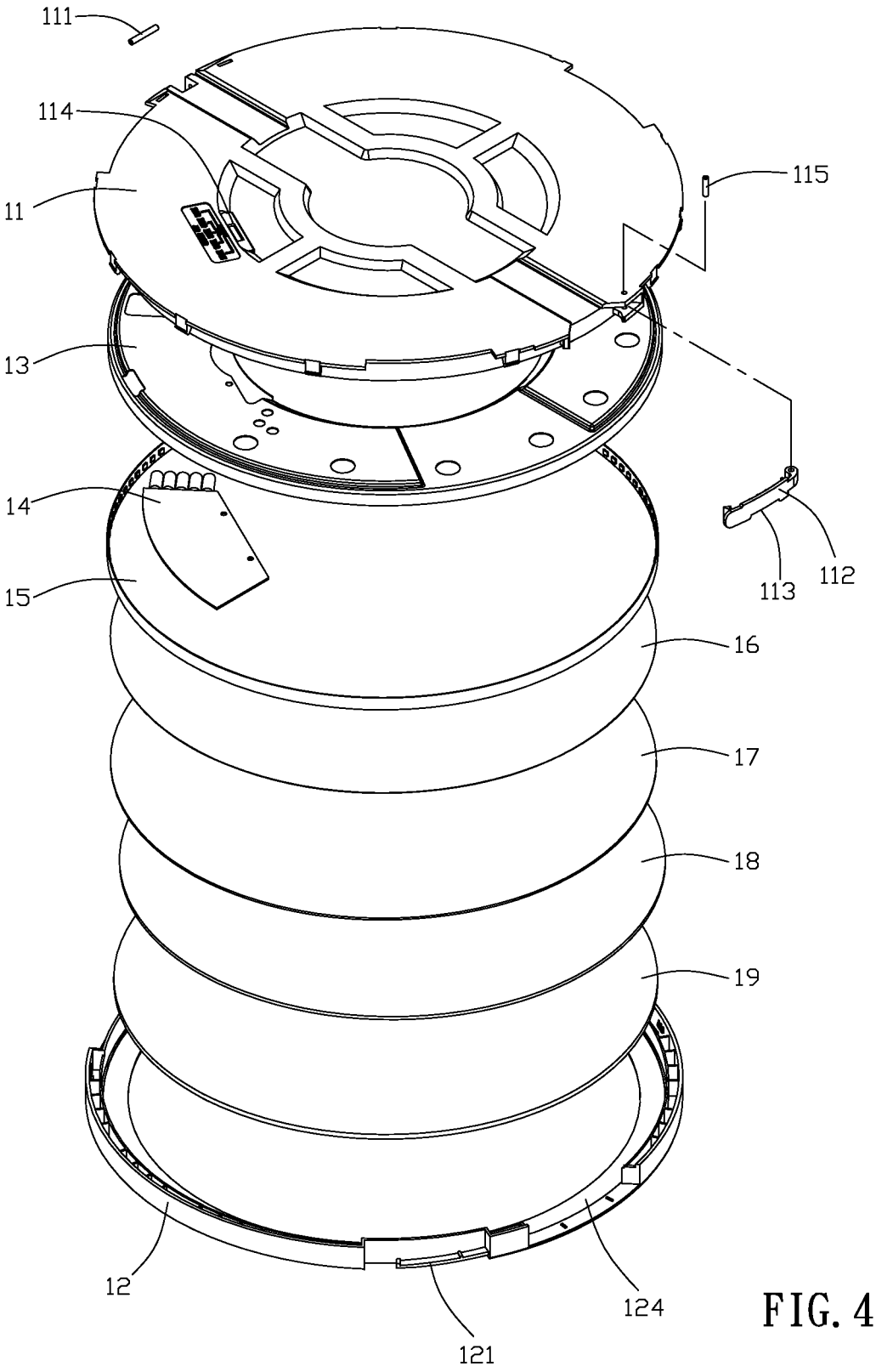
FIG. 4 is a partial exploded perspective view of the ceiling lamp in accordance with the first preferred embodiment of the present invention.
Figure 5:
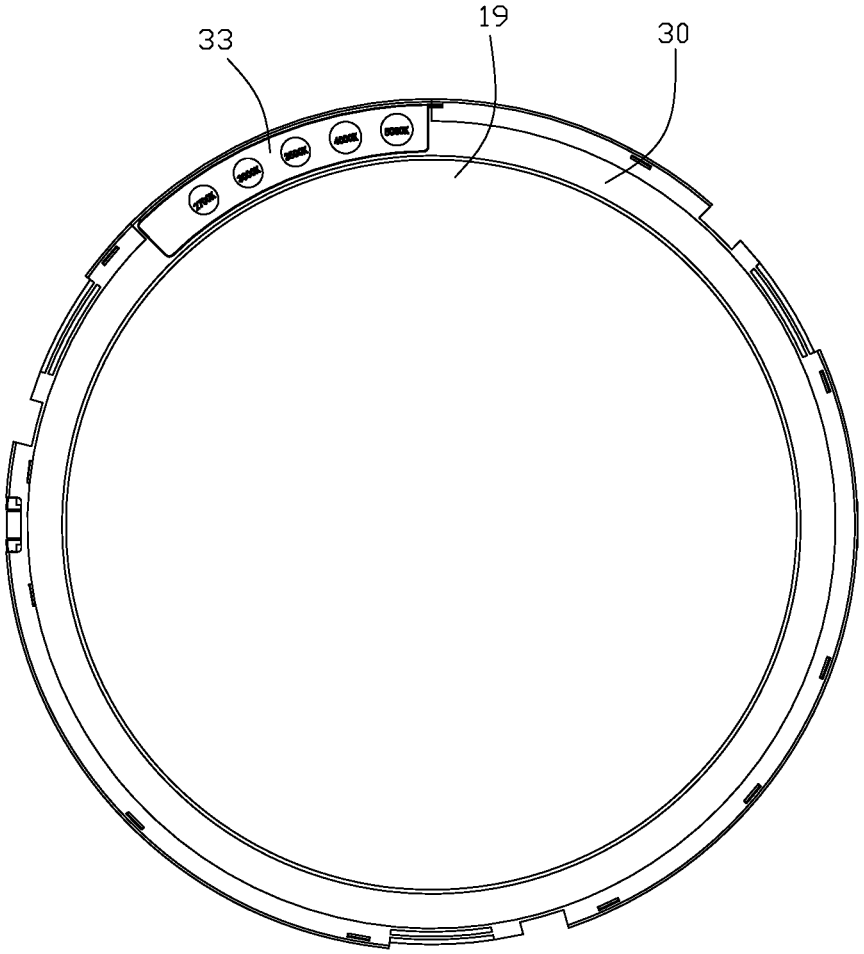
FIG. 5 is a schematic view showing that the membrane button is arranged on the bottom face of the lamp disk.
Figure 6:
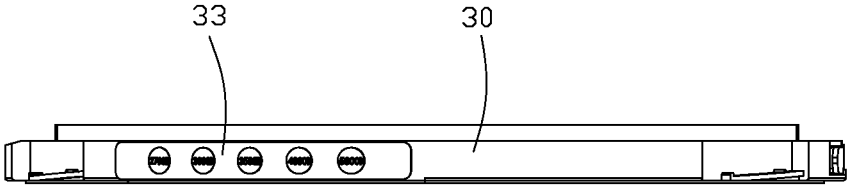
FIG. 6 is a schematic view showing that the membrane button is arranged on the outer face of the lamp disk.

In the preferred embodiment of the present invention, the rear cover 11 has an outer face provided with a rotation shaft (or first mounting portion) 111 (as shown in FIG. 4) and a locking snap (or second mounting portion) 112. The rotation shaft 111 is opposite to the locking snap 112. The locking snap 112 is mounted pivotally on the rear cover 11 by a pivot shaft 115 (as shown in FIG. 4). The locking snap 112 is rotatable relative to the pivot shaft 115. The locking snap 112 has a bottom provided with a locking opening 113. The wall plate 20 has a first end provided with a mounting hole 21 (as shown in FIG. 2) and a second end provided with a press piece 22. The rotation shaft 111 extends through the mounting hole 21. The press piece 22 is pressed into and locked in the locking opening 113 of the locking snap 112. Thus, the locking snap 112 presses the press piece 22 to secure the wall plate 20 to the rear cover 11.

In the preferred embodiment of the present invention, the lamp body 10 further includes a front cover 12 mounted on the rear cover 11 from bottom to top. The lamp disk 30 is mounted on the front cover 12 and arranged outside of the front cover 12.

In the preferred embodiment of the present invention, the front cover 12 is secured to the rear cover 11 by locking holes and locking grooves. In the preferred embodiment of the present invention, the front cover 12 has an outer face provided with a plurality of locking protrusions 121. Each of the locking protrusions 121 has a top face extending upward slantingly. The top face of each of the locking protrusions 121 has a lowermost position provided with an entrance 122. The lamp disk 30 has an inner face provided with a plurality of limit posts 31 (as shown in FIG. 2). Each of the limit posts 31 is introduced respectively from the entrance 122 into one of the locking protrusions 121.

In the preferred embodiment of the present invention, the top face of each of the locking protrusions 121 is provided with at least two restriction projections 123. Each of the at least two restriction projections 123 has an arcuate shape in cross section. Each of the limit posts 31 is retained respectively by one of the at least two restriction projections 123.

In assembly, the lamp disk 30 is pushed upward and then rotated relative to the front cover 12, so that each of the limit posts 31 is introduced respectively from the entrance 122 through one of the at least two restriction projections 123 into one of the locking protrusions 121. Then, the lamp disk 30 is further rotated upward, so that each of the limit posts 31 is moved to pass another one of the at least two restriction projections 123. Then, the lamp disk 30 is released so that the lamp disk 30 is secured to the front cover 12 of the lamp body 10.

In the preferred embodiment of the present invention, the light output module is arranged between the LED module 15 and the front cover 12 and includes a reflector 16, a light guide plate (or board or panel) 17, a glass plate 18, and a diffuser (or diffuser plate) 19 arranged from top to bottom. The reflector 16 is arranged below the LED module 15. The diffuser 19 is arranged above the front cover 12 and rests on an inner face of the front cover 12. In the preferred embodiment of the present invention, the rear cover 11 has a top provided with a color temperature regulating switch 114.

In the preferred embodiment of the present invention, the front cover 12 has a bottom provided with a flange 124 (as shown in FIG. 4) extending radially and inwardly toward a center of the front cover 12 to support and restrict the light output module, and the lamp disk 30 has a bottom provided with a flange 32 (as shown in FIG. 2) extending radially and inwardly toward a center of the lamp disk 30 to support and restrict the light output module.

In the preferred embodiment of the present invention, the membrane button 33 is arranged on a bottom face (see FIG. 5) or an outer face (see FIG. 6) of the lamp disk 30. Thus, the user regulates directly the color temperature of the ceiling lamp without having to remove the lampshade, thereby facilitating operating the ceiling lamp.

Figure 7:
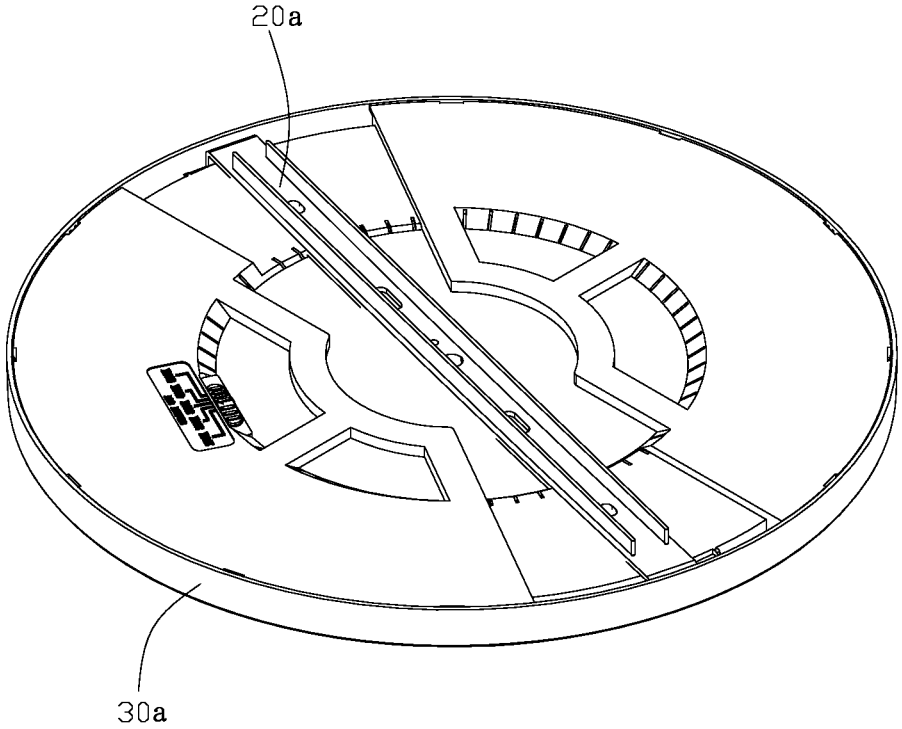
FIG. 7 is a perspective view of a ceiling lamp in accordance with the second preferred embodiment of the present invention.
Figure 8:
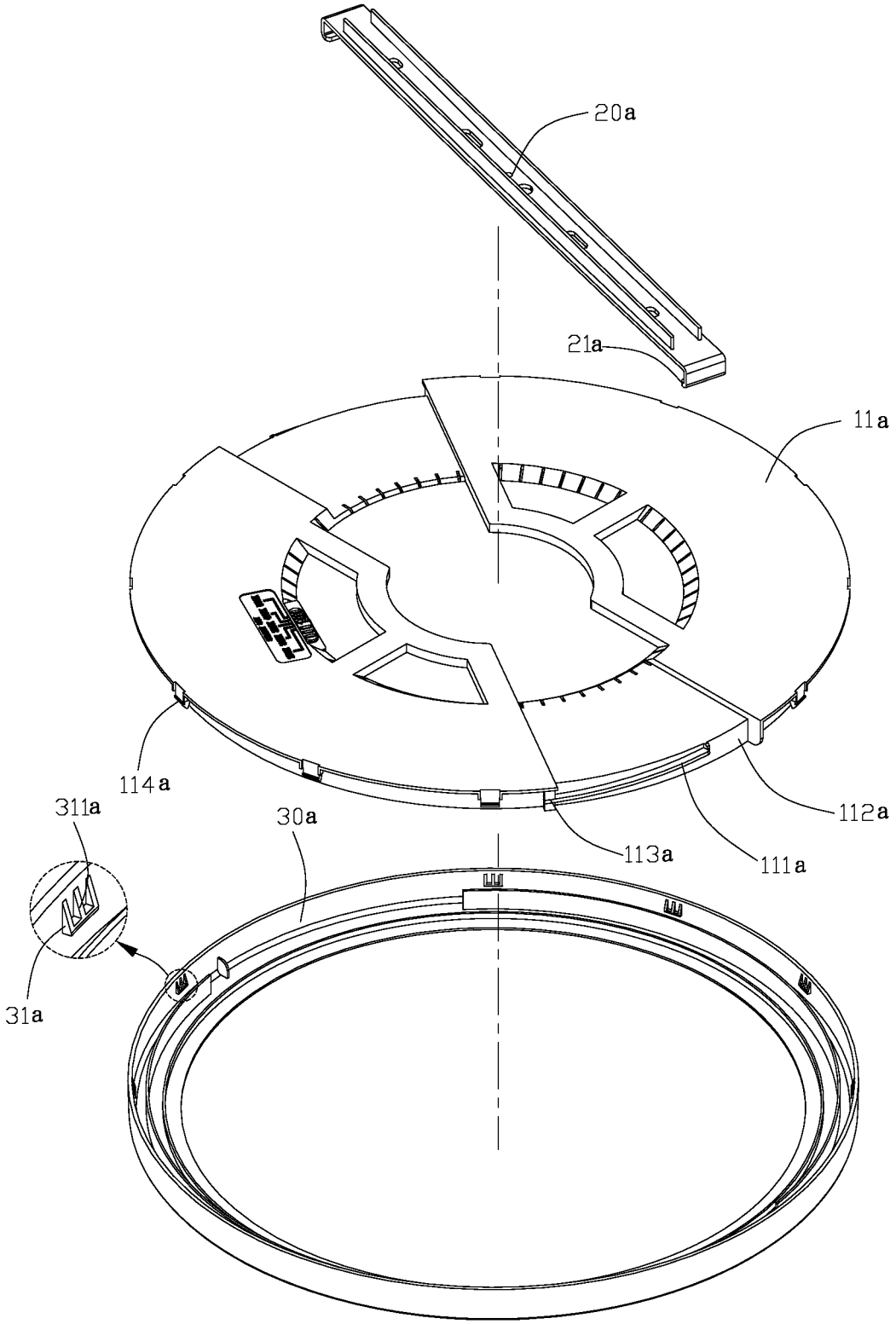
FIG. 8 is a partial exploded perspective view of the ceiling lamp in accordance with the second preferred embodiment of the present invention.

Referring to FIGS. 7 and 8, the rear cover 11*a* has an outer face provided with two inclined protruding rails 111*a*. Each of the two inclined protruding rails 111*a* has a bottom face extending slantingly. The bottom face of each of the two inclined protruding rails 111*a* has an uppermost position provided with an entrance 112*a*. The wall plate 20*a* is provided with two locking blocks 21*a* formed on two opposite ends thereof. Each of the two locking blocks 21*a* extends inward and is introduced respectively through the entrance 112*a* into the bottom face of one of the two inclined protruding rails 111*a*. The bottom face of each of the two inclined protruding rails 111*a* has a lowermost position provided with a stop portion 113*a* for stopping and limiting one of the two locking blocks 21*a*. The stop portion 113*a* and the entrance 112*a* are arranged on two opposite ends of each of the two inclined protruding rails 111*a*.

In assembly, when the rear cover 11*a* is mounted on the wall plate 20*a*, each of the two locking blocks 21*a* of the wall plate 20*a* is introduced respectively through the entrance 112*a* into the bottom face of one of the two inclined protruding rails 111*a*. Then, the rear cover 11*a* is rotated relative to the wall plate 20*a*, so that each of the two locking blocks 21*a* of the wall plate 20*a* is locked onto the lowermost position of the bottom face of one of the two inclined protruding rails 111*a* and stopped by the stop portion 113*a*.

The outer face of the rear cover 11*a* is provided with a plurality of locking hooks 114*a*. The lamp disk 30*a* has an inner face provided with a plurality of limit blocks 31*a*. Each of the limit blocks 31*a* is provided with an oblique guide face 311*a*. The oblique guide face 311*a* of each of the limit blocks 31*a* extends from outside to inside and is inclined downward slantingly. Each of the locking hooks 114*a* is moved downward on and guided by the oblique guide face 311*a* and locked on a bottom face of one of the limit blocks 31*a*.

Accordingly, the lamp body 10 is removably mounted on the wall plate 20, and the lamp disk 30 is removably mounted on the lamp body 10 so that the ceiling lamp is assembled and disassembled easily, quickly, and conveniently. In addition, the membrane button 33 is arranged on the bottom face or the outer face of the lamp disk 30, so that the user regulates directly the color temperature of the ceiling lamp without having to remove the lampshade, thereby facilitating operating the ceiling lamp to regulate the color temperature.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A ceiling lamp comprising:

a main unit and a wall plate detachably mounted on a top of the main unit;

wherein:

the main unit is provided with a membrane button for regulating a color temperature of the ceiling lamp;

the membrane button is arranged on a bottom face or an outer face of the main unit;

the main unit includes a lamp body, and a lamp disk mounted on the lamp body from bottom to top;

the lamp body includes a rear cover, a heatsink disk, a light emitting diode (LED) driver, an LED module, and a light output module;

the heatsink disk is mounted on a bottom of the rear cover;

the LED module is mounted between the heatsink disk and the light output module;

the LED driver is connected with the LED module;

the rear cover has an outer face provided with a rotation shaft and a locking snap;

the wall plate has a first end provided with a mounting hole and a second end provided with a press piece;

the rotation shaft extends through the mounting hole; and the locking snap presses the press piece to secure the wall plate to the rear cover.

2. The ceiling lamp as claimed in claim 1, wherein the light output module is arranged between the LED module and the front cover and includes a reflector, a light guide plate, a glass plate, and a diffuser arranged from top to bottom, and the diffuser rests on an inner face of the front cover.

3. The ceiling lamp as claimed in claim 1, wherein the rear cover has a top provided with a color temperature regulating switch.

4. A ceiling lamp comprising:

a main unit and a wall plate detachably mounted on a top of the main unit;

wherein:

the main unit is provided with a membrane button for regulating a color temperature of the ceiling lamp;

the membrane button is arranged on a bottom face or an outer face of the main unit;

the main unit includes a lamp body, and a lamp disk mounted on the lamp body from bottom to top;

the lamp body includes a rear cover, a heatsink disk, a light emitting diode (LED) driver, an LED module, and a light output module;

the heatsink disk is mounted on a bottom of the rear cover;

the LED module is mounted between the heatsink disk and the light output module;

the LED driver is connected with the LED module;

the rear cover has an outer face provided with two inclined protruding rails;

each of the two inclined protruding rails has a bottom face extending slantingly;

the bottom face of each of the two inclined protruding rails has an uppermost position provided with an entrance;

the wall plate is provided with two locking blocks formed on two opposite ends thereof; and each of the two locking blocks is introduced respectively through the entrance into the bottom face of one of the two inclined protruding rails.

5. The ceiling lamp as claimed in claim 4, wherein:

the outer face of the rear cover is provided with a plurality of locking hooks;

the lamp disk has an inner face provided with a plurality of limit blocks;

each of the limit blocks is provided with an oblique guide face; and each of the locking hooks is moved downward on and guided by the oblique guide face and locked on a bottom face of one of the limit blocks.

6. The ceiling lamp as claimed in claim 4, wherein the bottom face of each of the two inclined protruding rails has a lowermost position provided with a stop portion for stopping and limiting one of the two locking blocks.

7. A ceiling lamp comprising:

a main unit and a wall plate detachably mounted on a top of the main unit;

wherein:

the main unit is provided with a membrane button for regulating a color temperature of the ceiling lamp;

the membrane button is arranged on a bottom face or an outer face of the main unit;

the main unit includes a lamp body, and a lamp disk mounted on the lamp body from bottom to top;

the lamp body includes a rear cover, a heatsink disk, a light emitting diode (LED) driver, an LED module, and a light output module;

the heatsink disk is mounted on a bottom of the rear cover;

the LED module is mounted between the heatsink disk and the light output module;

the LED driver is connected with the LED module;

the lamp body further includes a front cover mounted on the rear cover from bottom to top, and the lamp disk is mounted on the front cover and arranged outside of the front cover;

the front cover has an outer face provided with a plurality of locking protrusions;

each of the locking protrusions has a top face extending upward slantingly;

the top face of each of the locking protrusions has a lowermost position provided with an entrance;

the lamp disk has an inner face provided with a plurality of limit posts; and each of the limit posts is introduced respectively from the entrance into one of the locking protrusions.

8. The ceiling lamp as claimed in claim 7, wherein:

the top face of each of the locking protrusions is provided with at least two restriction projections;

each of the at least two restriction projections has an arcuate shape in cross section; and each of the limit posts is retained respectively by one of the at least two restriction projections.

* * * * *